United States Patent [19]

Douwenga

[11] 4,169,345

[45] Oct. 2, 1979

[54] DEVICE FOR OPENING OUT THE FILLING APERTURES OF BAGS

[75] Inventor: Rudolf Douwenga, Emmen, Netherlands

[73] Assignee: Lockwood International B.V., Nieuw-Amsterdam, Netherlands

[21] Appl. No.: 837,283

[22] Filed: Sep. 27, 1977

[30] Foreign Application Priority Data

Dec. 22, 1976 [NL] Netherlands ..... 7614290

[51] Int. Cl.[2] ..... B65B 43/34

[52] U.S. Cl. ..... 53/570; 53/568; 53/384

[58] Field of Search ..... 53/187, 384, 183

[56] References Cited

U.S. PATENT DOCUMENTS

| | | | |
|---|---|---|---|
| 3,597,895 | 8/1971 | Jensen | 53/183 X |
| 3,744,211 | 7/1973 | Titchenal et al. | 53/187 X |

*Primary Examiner*—Travis S. McGehee

*Attorney, Agent, or Firm*—Staas & Halsey

[57] ABSTRACT

In a device for filling bags made from foil or similar material, the edges of each bag which form an opening are fed in so that each edge is held between a semi-rigid plate and a conveyor belt which is held against the plate to frictionally grip the respective edge of the bag. There are two semi-rigid plates which are hinged together at their ends, and to open the bag, one hinged end moves towards the other to cause the plates to bow out together with the surrounding conveyor belts. The bag can be filled through the opening between the plates.

8 Claims, 4 Drawing Figures

DEVICE FOR OPENING OUT THE FILLING APERTURES OF BAGS

FIELD OF THE INVENTION

The invention relates to a device for opening out the filling apertures of bags, particularly bags of foil material or the like which are connected together like a band.

BACKGROUND OF THE INVENTION

In known devices of the kind referred to above (German Pat. No. 2,047,774) the flexible spreader elements consist of link chains which are tensioned outwardly for forming the filling aperture at the respective bag. The adjuster means tensioning the respective link chain outwardly consists of an arcuate member provided with a traction rod, the member engaging the chain approximately in the centre of the filling aperture and pulling the same outwardly perpendicularly to the conveyance direction of the bags connected together like a band. This device comprises certain disadvantages. Since the flexible spreader elements are formed by chains, a rhombus-like filling aperture is produced upon tensioning the chains outwardly. Because of this rhombus-like filling aperture, acute deflections of the aperture edges of the bags occur at the corners of this rhombus, which may lead to damage to the bag material. Moreover the chain links subject the bag material likewise to considerable stress, namely even when the chains are provided with travelling driver members. These driver members lead to the further disadvantage that the chains must be constructed in a relatively complicated manner and thereby are expensive.

Furthermore the stressing referred to of the aperture edges of the bags limits the conveyance speed of the bags and thereby the processing speed of the apparatus.

SUMMARY OF THE INVENTION

According to the invention, there is provided a device for opening out the filling apertures of bags which are connected together in a strip, the device comprising two conveyor belts which run parallel and adjacent to each other so that the edges of the bag apertures can be fed between them, two blades arranged between the two conveyor belts so that each edge of a bag aperture can be received between a respective blade and belt, hinged joints joining the blades together at their ends, means mounting the joints so that at least one of joints can approach the other to cause the blades to expand outwards to spread apart the two conveyor belts and therefore also the edges of a bag aperture received between the respective blades and belts.

The blades may be constructed in one piece and in an elastic manner, or may consist each of at least two substantially rigid blade members which are pivotally connected together.

Furthermore, it can be advantageous to have one fixed and one movable joint. The movable joint can be mounted on a carriage which can be displaced towards the fixed joint and thus parallel to the conveyance direction of the bags. This carriage may be guided and appropriately reciprocated with simple means.

In a further advantageous construction of the device, each conveyor belt is guided by at least one compensation disc, and the discs are arranged on a common support which is displaceable together with the joint carriage. Thereby an accurate movement of the conveyor belts is secured in the course of the opening and closing movement of the blades.

In this context it is also advantageous that the support be connected to the carriage by means of a differential drive. This measure ensures that the conveyor belts are always sufficiently tensioned during the opening and closing movement.

A further advantageous embodiment of the invention consists in that the compensation sections of the conveyor belts which permit the conveyor belts to move together with the blades, are passed around belt pulleys which are disposed on the movable carriage for the movable joint.

A particularly accurate guidance of the conveyor belts in the region of the blades is obtained if the conveyor belts are guided in the region of the blades by means of displaceably disposed guide discs.

A further advantageous solution consists in the fact that a strip of elastic material which embraces the blade in a V-shaped manner is disposed between the respective blade and the associated conveyor belt. Owing to this measure, careful treatment of the bag material is ensured, and the friction forces between the conveyor belts, the blades and the bag material are kept as low as possible.

In the region of the ends of the blades a wedge-shaped spreader member may be provided at the inlet end as well as at the outlet end. Thereby an accurate and problem-free entry and outlet of the aperture edges is ensured in relation to the blades and the conveyor belts. The loading on the bag material is even further reduced thereby. The strip may be guided around at least one spreader member at the inlet end.

Obviously the joint pivot axes are arranged in relation to the blades in such a manner that a satisfactory lever arm is ensured which leads necessarily to the blades being spread apart. This may be ensured by arranging the joints between the blades. Thereby a sufficient lever arm is necessarily produced between the respective pivot axis and the blades, so that when the pivot points approach each other a reliable spreading apart of the blades in an outward direction results.

DESCRIPTION OF THE PREFERRED EMBODIMENT

Figure 1:
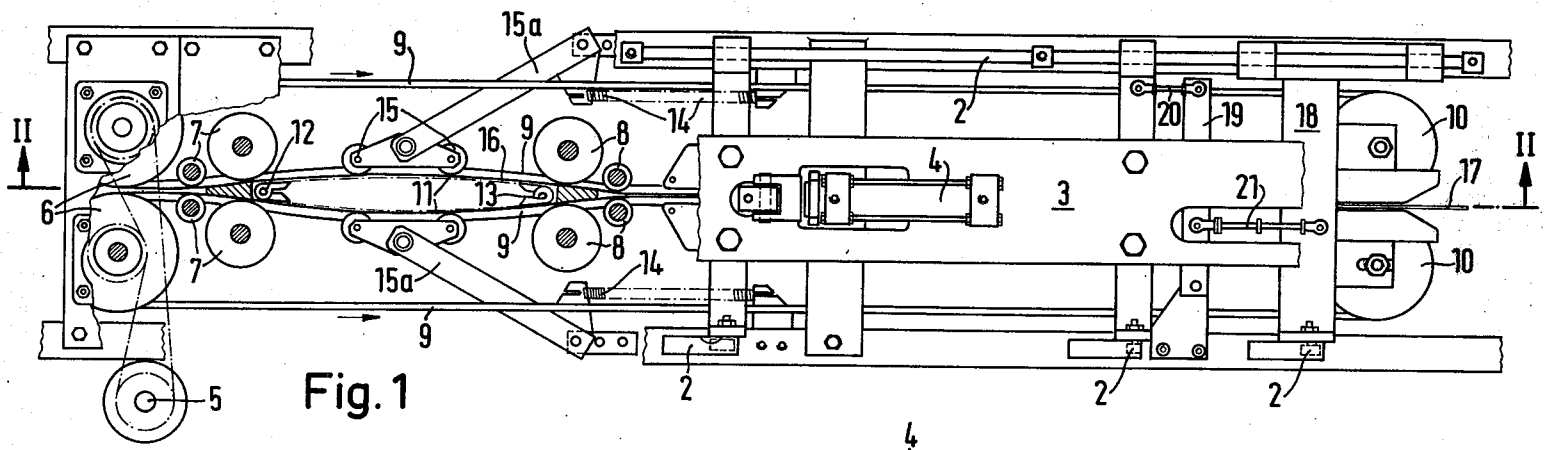
FIG. 1 is a diagrammatic view from above, partly in section, of a device according to the invention.
Figure 2:
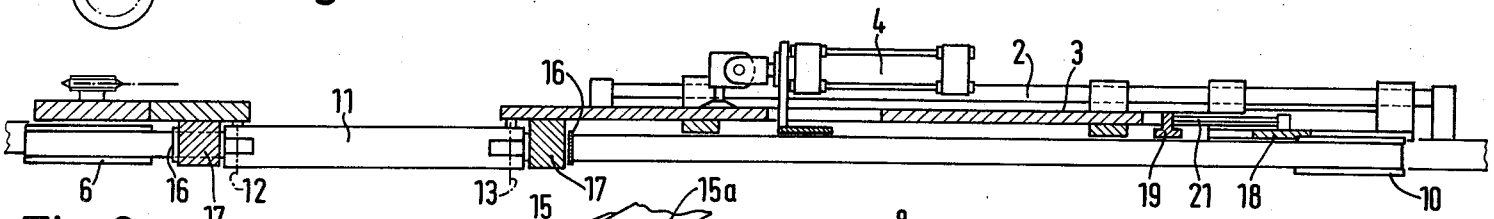
FIG. 2 is a longitudinal section through the device according to the section line II—II of FIG. 1.

The device for opening out the filling apertures of a longitudinally folded foil band sectioned to form individual bags comprises a mounting frame 1 on which two guide rods 2 are disposed which are parallel to each other and to the conveyance direction of the foil band and on which a carriage 3 is displaceable by means of, e.g., a pneumatically operating actuating device 4. The conveyance of the foil band is effected by means of two conveyor belts 9 which are guided in parallel and which engage and guide the aperture edges of the foil band. The drive and the guidance of the conveyor belts 9 is effected by means of appropriately disposed belt pulleys which are appropriately mounted on the mounting frame 1. Whereas the belt pulleys 6 are driven, e.g., by means of an electromotor 5, the belt pulley pairs 7 and 8 idle freely. Belt pulleys not denoted in detail may furthermore be freely rotatably arranged on the carriage 3.

Figure 3:
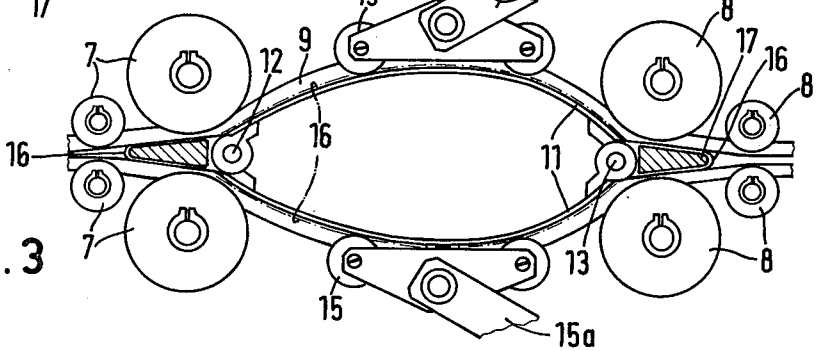
FIG. 3 shows on a larger scale, constructional components of the device in the position in which the bag located therein is open.
Figure 4:
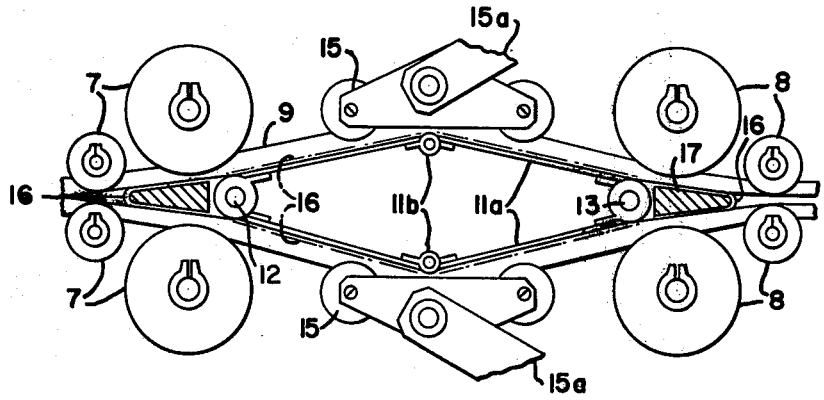
FIG. 4 shows the use of pivotably connected substantially rigid blade members.

For opening out the filling apertures of the individual bags conveyed in a stepwise manner, a spreader device is provided which is formed by two blades 11 which are disposed parallel to each other and to the conveyance direction of the foil band and the individual bags. Each blade 11 may consist of a single piece of resilient material, as is illustrated in FIG. 3, or of at least two substantially rigid blade members which are pivotably connected together. FIG. 4 illustrates substantially rigid blade members 11*a* pivotably connected by hinges 11*b*. The blades 11 come to rest between the aperture edges of the respective individual bag and in co-operation with the associated conveyor belts 9 clamp the edges. Now the blades are connected together at their two ends in a hinge-like manner by means of hinges or joints 12 and 13. Whereas the joint 12 is disposed stationarily on the mounting frame 1, the joint 13 is associated with the carriage 3 and is displaced together with the carriage 3. Opening out of the filling aperture of the respective bag is effected in that the carriage 3 and thereby the joint 13 is displaced in the conveyance direction towards the joint 12, whereby the blades 11 are spread away from each other. This movement is also performed by the conveyor belts 9 because of an arrangement still to be described in detail. Owing to the movement apart of the blades 11 and the conveyor belts 9 the aperture edges of the bag which are clamped between the said constructional components are likewise moved apart, whereby the filling aperture of the bag is opened. After filling has been performed, the carriage 3 is moved back taking the joint 13 with it to move the blades 11 and the conveyor belts 9 towards each other again, to close the filling aperture. The full bag closed in the manner described is drawn off the blades 11 by the conveyor belts 9 and the aperture edges of the next following bag to be filled are pushed on to the blades 11.

In order that the conveyor belts 9 can follow the described movements ot the blades 11, they are guided around compensation discs 10 which are mounted on a support 18 which is displaceable along the guide rods 2. The synchronisation of the movement of the displaceable support 18 with respect to the movement of the carriage 3 is effected by means of a delay lever 19 which on the one hand is rotatably connected to the mounting frame 1 and on the other hand co-operates with the carriage 3 by means of two coupling rods 20 and 21. The points of engagement of the coupling rods 20 and 21 on the delay lever 19 are so selected that the conveyor belts are just maintained under tension during the opening and closing movement of the blades 11.

In order to attain an accurate guidance of the conveyor belts 9 in the region of the blades 11 in spite of the reciprocatory movement, the conveyor belts 9 are additionally guided in the region of the blades 11 by means of guide rollers 15 which are mounted on arms 15*a* pivotally arranged on the mounting frame 1; the arms 15*a* are subjected to the effect of springs 14 in such a manner that the guide rollers 15 are always urged against the blades 11.

In order to obtain an accurate and problem-free entry of the aperture edges of the bags between the blades and the associated conveyor belts 9, a respective spreader member 17 is provided at the entry end as well as at the exit end. Whereas the spreader member 17 at the entry end widens out in a wedge-like manner, the spreader member 17 at the exit end tapers correspondingly in the conveyance direction. For further improving a trouble-free entry of the aperture edges of the bags between the blades 11 and the associated conveyor belts 9 it is advisable to dispose a V-shaped strip 16 of elastic material around the respective spreader member 17. This strip may also extend addditionally between the blades 11 and the associated conveyor belts 9.

In addition to bags to foil material, bags of other suitable materials, e.g., netting or the like, may be accurately manipulated by the apparatus described.

Using the blades described, a substantially oval filling aperture may be formed which permits uniform opening and closing of the aperture edges to be obtained without abrupt deflections. Thus, this device permits a high conveyance speed of the bags and thus a high filling speed without running the risk of an impermissible stressing of the material of the bags. Also the insertion of the aperture edges of the bags between the blades and the associated conveyor belts occurs without a sudden change of direction and is therefore free of problems. The same applies to the release of the bag after it has been filled. The device is also simple to construct and has a high operational reliability.

I claim:

1. A device for opening out the filling apertures of bags which are connected together in a strip, the device comprising:

two conveyor belts which run parallel and adjacent to each other so that the edges of the bag apertures can be fed between them;

two blades arranged between the two conveyor belts so that each edge of a bag aperture can be received between a repective blade and belt, each of the blades comprising at least two substantially rigid blade members which are pivotally connected together;

two hinged joints joining the blades together at their ends; and means mounting the joints for allowing at least one of the joints to approach the other to cause the blades to expand outwards to spread apart the two conveyor belts and therefore also the edges of a bag aperture received between the respective blades and belts.

2. The device of claim 1, further comprising a mounting frame, a carrage movably mounted on the frame, a movable support operationally connected to the carriage, and at least one rotatable compensation disc corresponding to each belt operationally connected to the support, and wherein one of the joints is fixed and the other is movable, the movable joint being operationally connected to the carriage and being displaceable towards the fixed joint, and each of the conveyor belts is guided around its corresponding at least one compensation disc.

3. A device for opening out the filling apertures of bags which are connected together with a strip, comprising:

a mounting frame;

a carriage movably mounted on the frames;

a movable support operationally connected to said carriage by means of a differential drive;

two conveyor belts;

means movably mounting the two conveyor belts to said frame for allowing the two conveyor belts to run parallel and adjacent to each other so that the edges of the bag apertures can be fed between them;

at least one compensation disc corresponding to each of the belts, each at least one compensation disc being operationally mounted on the support, each belt being guided around its corresponding at least one compensation disc;

two blades arranged between the two conveyor belts so that each edge of a bag aperture can be received between a respective blade and belt;

two hinged joints joining the blades together at their ends, one of the joints being fixed with respect to the frame and the other joint being operationally connected to the carriage and displaceable towards the fixed joint; and means mounting the joints for allowing at least one of the joints to approach the other to cause the blades to expand outwards to spread apart the two conveyor belts and therefore also the edges of a bag aperture received between the respective blades and belts.

4. The device of claim 3, further comprising means for permitting the conveyor belts to follow the movement of the blades, including at least one belt pulley corresponding to each of the belts, each at least one belt pulley being operationally connected to the carriage.

5. A device for opening out the filling apertures of bags which are connected together in a strip, the device comprising:

two conveyor belts which run parallel and adjacent to each other so that the edges of the bag apertures can be fed between them;

two blades arranged between the two conveyor belts so that each edge of a bag aperture can be received between a respective blade and belt;

two hinged joints joining the blades together at their ends;

means mounting the joints for allowing at least one of the joints to approach the other to cause the blades to expand outwards to spread apart the two conveyor belts and therefore also the edges of a bag aperture received between the respective blades and belts; and means for guiding the belts in the region of the blades, comprising at least on guide roller corresponding to each of the belts, each at least one guide roller being displaceable substantially at right angles to the direction in which the conveyor belts run.

6. A device for opening out the filling apertures of bags which are connected together in a strip, the device comprising:

two conveyor belts which run parallel and adjacent to each other so that the edges of the bag apertures can be fed between them;

two blades arranged between the two conveyor belts so that each edge of a bag aperture can be received between a respective blade and belt;

two hinged joints joining the blades together at their ends;

means mounting the joints for allowing at least one of the joints to approach the other to cause the blades to expand outward to spread apart the two conveyor belts and therefore also the edges of a bag aperture received between the respective blades and belts; and two V-shaped strips of elastic material, each strip being disposed between a respective joint and the conveyor belts.

7. The device of claim 6, further comprising two wedge-shaped spreader members in the region of the ends of the blades, one spreader member being provided between the conveyor belts upstream of the bag entry end, and the other spreader member being provided between the belts downstream of the bag exit end.

8. The device of claim 7, wherein an elastic strip is disposed around at least the spreader member at the entry end.

* * * * *

UNITED STATES PATENT AND TRADEMARK OFFICE

CERTIFICATE OF CORRECTION

PATENT NO. : 4,169,345

DATED : October 2, 1979

INVENTOR(S) : Rudolf Douwenga

It is certified that error appears in the above–identified patent and that said Letters Patent are hereby corrected as shown below:

* Col. 3, line 19, "co-operation" should be --cooperation--.

* Col. 3, line 48, "synchronisation" should be --synchronization-

* Col. 3, line 52, "co-operates" should be --cooperates--.

* Col. 4, line 38, "repective" should be --respective--.

* Col. 4, line 51, "carrage" should be --carriage--.

Signed and Sealed this

*Twenty-second* Day of *January 1980*

[SEAL]

*Attest:*

SIDNEY A. DIAMOND

*Attesting Officer*

*Commissioner of Patents and Trademarks*